US009772606B1

(12) United States Patent
Cho et al.

(10) Patent No.: US 9,772,606 B1
(45) Date of Patent: Sep. 26, 2017

(54) WATCH TYPE TERMINAL

(71) Applicant: LG ELECTRONICS INC., Seoul (KR)

(72) Inventors: Changhyun Cho, Seoul (KR); Yonghee Lee, Seoul (KR); Byoungdoo Kim, Seoul (KR); Heeyong Kwon, Seoul (KR); Hyunseok Oh, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 15/163,135

(22) Filed: May 24, 2016

(30) Foreign Application Priority Data

Mar. 10, 2016 (KR) ..... 10-2016-0028951

(51) Int. Cl.
*G04B 19/04* (2006.01)
*G04C 17/00* (2006.01)

(52) U.S. Cl.
CPC ..... *G04C 17/005* (2013.01); *G04B 19/04* (2013.01)

(58) Field of Classification Search
CPC .. G04C 17/005; G04C 17/0066; G04B 19/04; G04B 37/00; G04B 37/06; G04B 19/20; G04B 19/202
USPC ..... 368/77, 221, 233, 234
See application file for complete search history.

(56) References Cited

U.S. PATENT DOCUMENTS 2,723,527 A * 11/1955 Smith ..... G04B 19/202 368/233
6,147,933 A * 11/2000 Bland ..... G04G 9/0082 368/223
2012/0147711 A1 6/2012 Lai
2014/0347963 A1 11/2014 El Alej et al.

* cited by examiner

*Primary Examiner* — Sean Kayes
(74) *Attorney, Agent, or Firm* — Birch, Stewart, Kolasch & Birch, LLP

(57) ABSTRACT

The present disclosure relates to a watch type terminal including a body comprising a display unit and a band connected to the body and formed to be worn on a wrist, wherein the body includes a first disk configured to overlap with the display unit and comprise a first hand, a second disk disposed below the first disk to comprise a second hand, a first and a second pinion coupled to the edges of the first and the second disk, respectively, and a rotation drive unit configured to provide a rotational force to the pinions to rotate the first and the second disk so as to display visual information by the first and the second hand.

18 Claims, 13 Drawing Sheets

WATCH TYPE TERMINAL

CROSS-REFERENCE TO RELATED APPLICATIONS

Pursuant to 35 U.S.C. §119(a), this application claims the benefit of earlier filing date and right of priority to Korean Application No. 10-2016-0028951, filed in the Republic of Korea on Mar. 10, 2016, the contents of which are incorporated by reference herein in its entirety.

BACKGROUND OF THE DISCLOSURE

1. Field of the Disclosure

The present disclosure relates to a watch type terminal including rotating clock hands to indicate a time.

2. Background of the Disclosure

Terminals may be divided into mobile/portable terminals and stationary terminals according to their mobility. Also, the mobile terminals may be classified into handheld terminals and vehicle mount terminals according to whether or not a user can directly carry it.

As it becomes multifunctional, a mobile terminal can be allowed to capture still images or moving images, play music or video files, play games, receive broadcast and the like, so as to be implemented as an integrated multimedia player. Moreover, the improvement in the aspect of structure and software of a mobile terminal may be taken into consideration to support and enhance the functions of the mobile terminal.

As the types of visual information displayed on a display unit have increased, a size of the display unit has been gradually increased, and users' needs for high definition displays have been increased.

In recent years, a watch type terminal worn on a user's wrist and provided with a display unit configured to display various information as well as a time has been developed. Furthermore, users' needs for a watch type terminal implemented in a shape similar to a typical analog watch have been increased. In particular, in order to implement moving hands to indicate a time, there is a drawback in which part of a display module should be modified or reduced to dispose a drive device for moving hands.

SUMMARY OF THE DISCLOSURE

Accordingly, an object of the present disclosure is to provide a watch type terminal including actual hands while maximizing a display region.

In order to accomplish the task of the present disclosure, a watch type terminal according to an embodiment may include a body comprising a display unit, and a band connected to the body and formed to be worn on a wrist, wherein the body includes a first disk configured to overlap with the display unit and comprise a first hand, a second disk disposed below the first disk to comprise a second hand, a first and a second gear pinion coupled to the edges of the first and the second disk, respectively, and a rotation drive unit configured to provide a rotational force to the gear pinions to rotate the first and the second disk so as to display visual information by the first and the second hand.

According to an example associated with the present disclosure, the edges of the first and the second disk may be configured with a gear unit coupled to the first and the second gear pinion, respectively, and therefore, a structure for rotating the first and the second disk regardless of a region disposed with a display module on which an image is displayed.

According to an example associated with the present disclosure, a first through a third support portion that support the first and the second may include a first and a second protrusion formed to be brought into point contact with the first and the second disk. As a result, the first and the second disk may be supported not to collide with each other while minimizing a friction with the first and the second disk rotated by them.

According to an example associated with the present disclosure, a first and a second antenna with different frequency characteristics may be implemented by a first and a second gear pinion formed of a metal material and a metal portion of the first disk.

According to an example associated with the present disclosure, the first and the second disk may be independently rotated to temporarily move a first and a second hand regardless of a current time.

According to the present disclosure, a disk including a hand for indicating a time may be rotated by a gear formed in an edge region of the disk, and therefore, the modification of a display unit disposed to overlap with the disk is not required. Accordingly, it may be possible to secure a visual information display region on the display unit.

Furthermore, a frame supporting the disk may include a protrusion formed to be brought into point contact with a surface of the disk, thereby stably supporting a rotating disk while minimizing a contact friction.

BRIEF DESCRIPTION OF THE DRAWINGS

The present invention will become more fully understood from the detailed description given herein below and the accompanying drawings, which are given by illustration only, and thus are not limitative of the present invention, and wherein.

DETAILED DESCRIPTION OF THE PREFERRED EMBODIMENTS

Description will now be given in detail according to the exemplary embodiments disclosed herein, with reference to the accompanying drawings. For the sake of brief description with reference to the drawings, the same or equivalent components will be provided with the same reference numbers, and description thereof will not be repeated. A suffix "module" and "unit" used for constituent elements disclosed in the following description is merely intended for easy description of the specification, and the suffix itself does not give any special meaning or function. In describing the present disclosure, if a detailed explanation for a related known function or construction is considered to unnecessarily divert the gist of the present disclosure, such explanation has been omitted but would be understood by those skilled in the art. The accompanying drawings are used to help easily understand the technical idea of the present disclosure and it should be understood that the idea of the present disclosure is not limited by the accompanying drawings. The idea of the present disclosure should be construed to extend to any alterations, equivalents and substitutes besides the accompanying drawings.

It will be understood that, although the terms first, second, etc. may be used herein to describe various elements, these elements should not be limited by these terms. These terms are only used to distinguish one element from another.

It will be understood that when an element is referred to as being "connected with" another element, the element can be directly connected with the other element or intervening elements may also be present. In contrast, when an element is referred to as being "directly connected with" another element, there are no intervening elements present.

A singular representation may include a plural representation as far as it represents a definitely different meaning from the context.

Terms 'include' or 'has' used herein should be understood that they are intended to indicate an existence of several components or several steps, disclosed in the specification, and it may also be understood that part of the components or steps may not be included or additional components or steps may further be included.

Mobile terminals described herein may include cellular phones, smart phones, laptop computers, digital broadcasting terminals, personal digital assistants (PDAs), portable multimedia players (PMPs), navigators, slate PCs, tablet PCs, ultra books, wearable devices (for example, smart watches, smart glasses, head mounted displays (HMDs)), and the like.

However, it may be easily understood by those skilled in the art that the configuration according to the exemplary embodiments of this specification can also be applied to stationary terminals such as digital TV, desktop computers and the like, excluding a case of being applicable only to the mobile terminals.

Figure 1A:
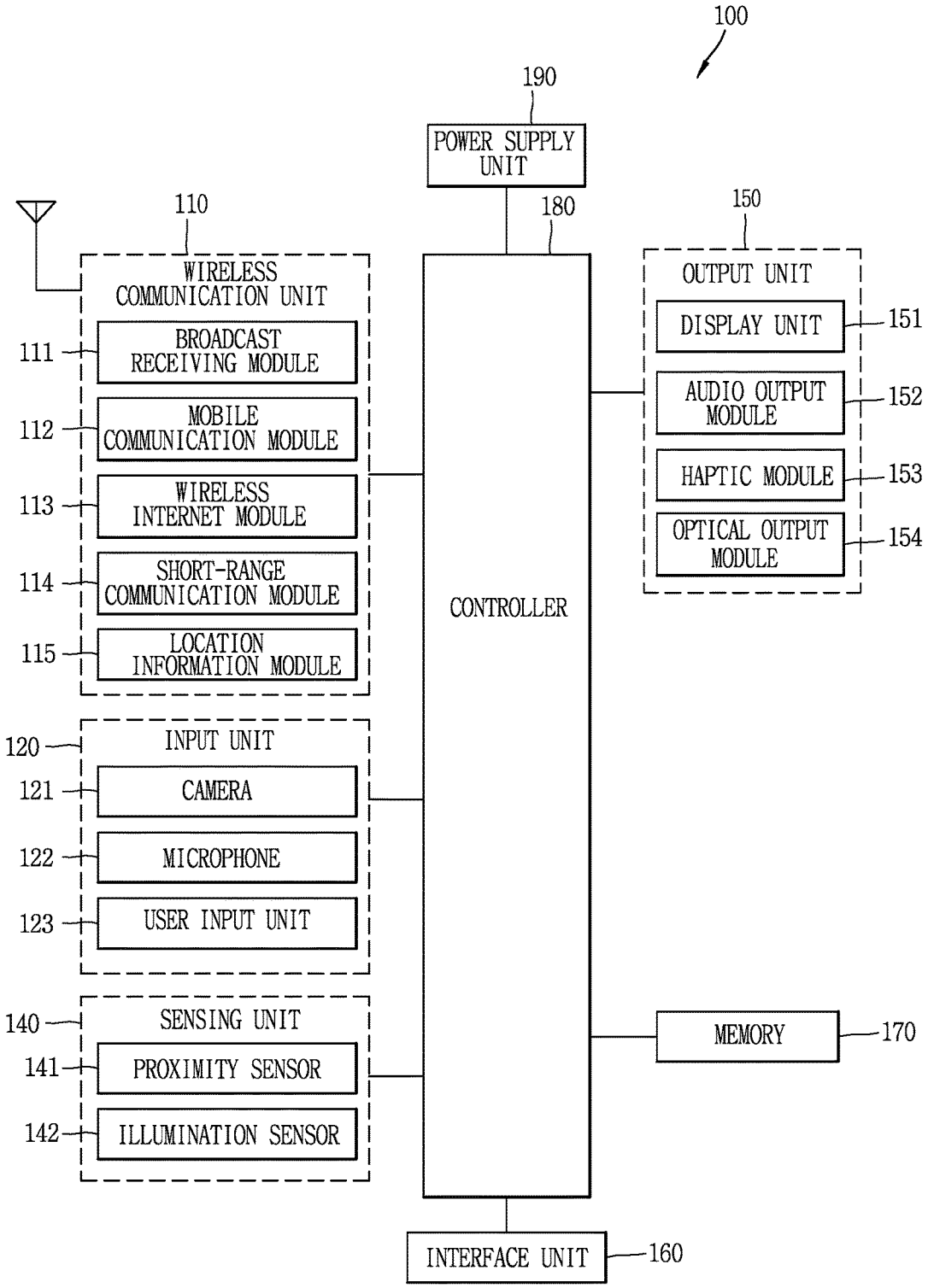
FIG. 1A is a block diagram for explaining a mobile terminal associated with the present disclosure.

FIG. 1A is a block diagram of a mobile terminal for explaining a mobile terminal associated with the present disclosure.

The mobile terminal 100 may include components, such as a wireless communication unit 110, an input unit 120, a sensing unit 140, an output unit 150, an interface unit 160, a memory 170, a controller 180, a power supply unit 190 and the like. FIG. 1A illustrates the mobile terminal having various components, but it may be understood that implementing all of the illustrated components is not a requirement. Greater or fewer components may alternatively be implemented.

In more detail, the wireless communication unit 110 of those components may typically include one or more modules which permit wireless communications between the mobile terminal 100 and a wireless communication system, between the mobile terminal 100 and another mobile terminal 100, or between the mobile terminal 100 and a network within which another mobile terminal 100 (or an external server) is located.

For example, the wireless communication unit 110 may include at least one of a broadcast receiving module 111, a mobile communication module 112, a wireless Internet module 113, a short-range communication module 114, a location information module 115 and the like.

The input unit 120 may include a camera 121 for inputting an image signal, a microphone 122 or an audio input module for inputting an audio signal, or a user input unit 123 (for example, a touch key, a push key (or a mechanical key), etc.) for allowing a user to input information. Audio data or image data collected by the input unit 120 may be analyzed and processed by a user's control command.

The sensing unit 140 may include at least one sensor which senses at least one of internal information of the mobile terminal, a surrounding environment of the mobile terminal and user information. For example, the sensing unit 140 may include a proximity sensor 141, an illumination sensor 142, a touch sensor, an acceleration sensor, a magnetic sensor, a G-sensor, a gyroscope sensor, a motion sensor, an RGB sensor, an infrared (IR) sensor, a finger scan sensor, a ultrasonic sensor, an optical sensor (for example, refer to the camera 121), a microphone 122, a battery gage, an environment sensor (for example, a barometer, a hygrometer, a thermometer, a radiation detection sensor, a thermal sensor, a gas sensor, etc.), and a chemical sensor (for example, an electronic nose, a health care sensor, a biometric sensor, etc.). On the other hand, the mobile terminal disclosed herein may utilize information in such a manner of combining information sensed by at least two sensors of those sensors.

The output unit 150 may be configured to output an audio signal, a video signal or a tactile signal. The output unit 150 may include a display unit 151, an audio output module 152, a haptic module 153, an optical output module 154 and the like. The display unit 151 may have an inter-layered structure or an integrated structure with a touch sensor so as to implement a touch screen. The touch screen may provide an output interface between the mobile terminal 100 and a user, as well as functioning as the user input unit 123 which provides an input interface between the mobile terminal 100 and the user.

The interface unit 160 may serve as an interface with various types of external devices connected with the mobile terminal 100. The interface unit 160, for example, may include wired or wireless headset ports, external power supply ports, wired or wireless data ports, memory card ports, ports for connecting a device having an identification module, audio input/output (I/O) ports, video I/O ports, earphone ports, or the like. The mobile terminal 100 may execute an appropriate control associated with a connected external device, in response to the external device being connected to the interface unit 160.

The memory 170 may store a plurality of application programs (or applications) executed in the mobile terminal 100, data for operations of the mobile terminal 100, instruction words, and the like. At least some of those application programs may be downloaded from an external server via wireless communication. Some others of those application programs may be installed within the mobile terminal 100 at the time of being shipped for basic functions of the mobile terminal 100 (for example, receiving a call, placing a call, receiving a message, sending a message, etc.). On the other hand, the application programs may be stored in the memory 170, installed in the mobile terminal 100, and executed by the controller 180 to perform an operation (or a function) of the mobile terminal 100.

The controller 180 may typically control an overall operation of the mobile terminal 100 in addition to the operations associated with the application programs. The controller 180 may provide or process information or functions appropriate for a user in a manner of processing signals, data, information and the like, which are input or output by the aforementioned components, or activating the application programs stored in the memory 170.

The controller 180 may control at least part of the components illustrated in FIG. 1A, in order to drive the application programs stored in the memory 170. In addition, the controller 180 may drive the application programs by combining at least two of the components included in the mobile terminal 100 for operation.

The power supply unit 190 may receive external power or internal power and supply appropriate power required for operating respective elements and components included in the mobile terminal 100 under the control of the controller 180. The power supply unit 190 may include a battery, and the battery may be an embedded battery or a replaceable battery.

At least part of those elements and components may be combined to implement operation and control of the mobile terminal or a control method of the mobile terminal according to various exemplary embodiments described herein. Also, the operation and control or the control method of the mobile terminal may be implemented in the mobile terminal in such a manner of activating at least one application program stored in the memory 170.

Hereinafter, each aforementioned component will be described in more detail with reference to FIG. 1A, prior to explaining various exemplary embodiments implemented by the mobile terminal 100 having the configuration.

First, the wireless communication unit 110 will be described. The broadcast receiving module 111 of the wireless communication unit 110 may receive a broadcast signal and/or broadcast associated information from an external broadcast managing entity via a broadcast channel. The broadcast channel may include a satellite channel and a terrestrial channel. At least two broadcast receiving modules 111 may be provided in the mobile terminal 100 to simultaneously receive at least two broadcast channels or switch the broadcast channels.

The mobile communication module 112 may transmit/receive wireless signals to/from at least one of network entities, for example, a base station, an external mobile terminal, a server, and the like, on a mobile communication network, which is constructed according to technical standards or transmission methods for mobile communications (for example, Global System for Mobile Communication (GSM), Code Division Multi Access (CDMA), Wideband CDMA (WCDMA), High Speed Downlink Packet access (HSDPA), Long Term Evolution (LTE), Long Term Evolution-Advanced (LTE-A) etc.)

Here, the wireless signals may include audio call signal, video (telephony) call signal, or various formats of data according to transmission/reception of text/multimedia messages.

The wireless Internet module 113 denotes a module for wireless Internet access. This module may be internally or externally coupled to the mobile terminal 100. The wireless Internet module 113 may transmit/receive wireless signals via communication networks according to wireless Internet technologies.

Examples of such wireless Internet access may include Wireless LAN (WLAN), Wireless Fidelity (Wi-Fi) Direct, Digital Living Network Alliance (DLNA), Wireless Broadband (Wibro), Worldwide Interoperability for Microwave Access (Wimax), High Speed Downlink Packet Access (HSDPA), Long Term Evolution (LTE), Long Term Evolution-Advanced (LTE-A) and the like. The wireless Internet module 113 may transmit/receive data according to at least one wireless Internet technology within a range including even Internet technologies which are not aforementioned.

From the perspective that the wireless Internet accesses according to Wibro, HSDPA, GSM, CDMA, WCDMA, LTE, LTE-A and the like are executed via a mobile communication network, the wireless Internet module 113 which performs the wireless Internet access via the mobile communication network may be understood as a type of the mobile communication module 112.

The short-range communication module 114 denotes a module for short-range communications. Suitable technologies for implementing the short-range communications may include BLUETOOTH™, Radio Frequency IDentification (RFID), Infrared Data Association (IrDA), Ultra-WideBand (UWB), ZigBee, Near Field Communication (NFC), Wireless-Fidelity (Wi-Fi), Wi-Fi Direct, and the like. The short-range communication module 114 may support wireless communications between the mobile terminal 100 and a wireless communication system, between the mobile terminal 100 and another mobile terminal 100, or between the mobile terminal and a network where another mobile terminal 100 (or an external server) is located, via wireless personal area networks.

Here, the another mobile terminal 100 may be a wearable device, for example, a smart watch, a smart glass or a head mounted display (HMD), which is able to exchange data with the mobile terminal 100 (or to cooperate with the mobile terminal 100). The short-range communication module 114 may sense (recognize) a wearable device, which is able to communicate with the mobile terminal), near the mobile terminal 100. In addition, when the sensed wearable device is a device which is authenticated to communicate with the mobile terminal 100 according to the present disclosure, the controller 180 may transmit at least part of data processed in the mobile terminal 100 to the wearable device via the short-range communication module 114. Hence, a user of the wearable device may use the data processed in the mobile terminal 100 on the wearable device. For example, when a call is received in the mobile terminal 100, the user may answer the call using the wearable device. Also, when a message is received in the mobile terminal 100, the user may check the received message using the wearable device.

The location information module 115 denotes a module for detecting or calculating a position of the mobile terminal. An example of the location information module 115 may include a Global Position System (GPS) module or a Wi-Fi module. For example, when the mobile terminal uses the GPS module, a position of the mobile terminal may be acquired using a signal sent from a GPS satellite. As another example, when the mobile terminal uses the Wi-Fi module, a position of the mobile terminal may be acquired based on information related to a wireless access point (AP) which transmits or receives a wireless signal to or from the Wi-Fi module. According to the need, the location information module 115 may perform any function of the other modules of the wireless communication unit 110 to obtain data on the location of the mobile terminal. As a module used to acquire the location (or current location) of the mobile terminal, the location information module 115 may not be necessarily limited to a module for directly calculating or acquiring the location of the mobile terminal.

Hereinafter, the input unit 120 will be described in more detail. The input unit 120 may be configured to provide an audio or video signal (or information) input to the mobile terminal or information input by a user to the mobile terminal. For the input of the audio information, the mobile terminal 100 may include one or a plurality of cameras 121. The camera 121 may process image frames of still pictures or video obtained by image sensors in a video call mode or a capture mode. The processed image frames may be displayed on the display unit 151. On the other hand, the plurality of cameras 121 disposed in the mobile terminal 100 may be arranged in a matrix configuration. By use of the cameras 121 having the matrix configuration, a plurality of image information having various angles or focal points may be input into the mobile terminal 100. Also, the plurality of cameras 121 may be arranged in a stereoscopic structure to acquire a left image and a right image for implementing a stereoscopic image.

The microphone 122 may process an external audio signal into electric audio data. The processed audio data may be utilized in various manners according to a function being executed in the mobile terminal 100 (or an application program being executed). On the other hand, the microphone 122 may include assorted noise removing algorithms to remove noise generated in the course of receiving the external audio signal.

The user input unit 123 may receive information input by a user. When information is input through the user input unit 123, the controller 180 may control an operation of the mobile terminal 100 to correspond to the input information. The user input unit 123 may include a mechanical input element (or a mechanical key, for example, a button located on a front/rear surface or a side surface of the mobile terminal 100, a dome switch, a jog wheel, a jog switch, etc.), and a touch-sensitive input means. As one example, the touch-sensitive input means may be a virtual key, a soft key or a visual key, which is displayed on a touch screen through software processing, or a touch key which is disposed on a portion except for the touch screen. On the other hand, the virtual key or the visual key may be displayable on the touch screen in various shapes, for example, graphic, text, icon, video or a combination thereof.

The sensing unit 140 may sense at least one of internal information of the mobile terminal, surrounding environment information of the mobile terminal and user information, and generate a sensing signal corresponding to it. The controller 180 may control an operation of the mobile terminal 100 or execute data processing, a function or an operation associated with an application program installed in the mobile terminal based on the sensing signal. Hereinafter, description will be given in more detail of representative sensors of various sensors which may be included in the sensing unit 140.

First, a proximity sensor 141 refers to a sensor to sense presence or absence of an object approaching to a surface to be sensed, or an object disposed near a surface to be sensed, by using an electromagnetic field or infrared rays without a mechanical contact. The proximity sensor 141 may be arranged at an inner region of the mobile terminal covered by the touch screen, or near the touch screen. The proximity sensor 141 may have a longer lifespan and a more enhanced utility than a contact sensor.

The proximity sensor 141, for example, may include a transmissive type photoelectric sensor, a direct reflective type photoelectric sensor, a mirror reflective type photoelectric sensor, a high-frequency oscillation proximity sensor, a capacitance type proximity sensor, a magnetic type proximity sensor, an infrared rays proximity sensor, and so on. When the touch screen is implemented as a capacitance type, the proximity sensor 141 may sense proximity of a pointer to the touch screen by changes of an electromagnetic field, which is responsive to an approach of an object with conductivity. In this case, the touch screen (touch sensor) may be categorized into a proximity sensor.

Hereinafter, for the sake of brief explanation, a status that the pointer is positioned to be proximate onto the touch screen without contact will be referred to as 'proximity touch,' whereas a status that the pointer substantially comes in contact with the touch screen will be referred to as 'contact touch.' For the position corresponding to the proximity touch of the pointer on the touch screen, such position will correspond to a position where the pointer faces perpendicular to the touch screen upon the proximity touch of the pointer. The proximity sensor 141 may sense proximity touch, and proximity touch patterns (e.g., distance, direction, speed, time, position, moving status, etc.). On the other hand, the controller 180 may process data (or information) corresponding to the proximity touches and the proximity touch patterns sensed by the proximity sensor 141, and output visual information corresponding to the process data on the touch screen. In addition, the controller 180 may control the mobile terminal 100 to execute different operations or process different data (or information) according to whether a touch with respect to the same point on the touch screen is either a proximity touch or a contact touch.

A touch sensor may sense a touch (or touch input) applied onto the touch screen (or the display unit 151) using at least one of various types of touch methods, such as a resistive type, a capacitive type, an infrared type, a magnetic field type, and the like.

As one example, the touch sensor may be configured to convert changes of pressure applied to a specific part of the display unit 151 or a capacitance occurring from a specific part of the display unit 151, into electric input signals. Also, the touch sensor may be configured to sense not only a touched position and a touched area, but also touch pressure. Here, a touch object is an object to apply a touch input onto the touch sensor. Examples of the touch object may include a finger, a touch pen, a stylus pen, a pointer or the like.

When touch inputs are sensed by the touch sensors, corresponding signals may be transmitted to a touch controller. The touch controller may process the received signals, and then transmit corresponding data to the controller 180. Accordingly, the controller 180 may sense which region of the display unit 151 has been touched. Here, the touch controller may be a component separate from the controller 180 or the controller 180 itself.

On the other hand, the controller 180 may execute a different control or the same control according to a type of an object which touches the touch screen (or a touch key provided in addition to the touch screen). Whether to execute the different control or the same control according to the object which gives a touch input may be decided based on a current operating state of the mobile terminal 100 or a currently executed application program.

Meanwhile, the touch sensor and the proximity sensor may be executed individually or in combination, to sense various types of touches, such as a short (or tap) touch, a long touch, a multi-touch, a drag touch, a flick touch, a pinch-in touch, a pinch-out touch, a swipe touch, a hovering touch, and the like.

An ultrasonic sensor may be configured to recognize position information relating to a sensing object by using ultrasonic waves. The controller 180 may calculate a position of a wave generation source based on information sensed by an illumination sensor and a plurality of ultrasonic sensors. Since light is much faster than ultrasonic waves, a time for which the light reaches the optical sensor may be much shorter than a time for which the ultrasonic wave reaches the ultrasonic sensor. The position of the wave generation source may be calculated using the fact. In more detail, the position of the wave generation source may be calculated by using a time difference from the time that the ultrasonic wave reaches based on the light as a reference signal.

The camera 121 constructing the input unit 120 may be a type of camera sensor. The camera sensor may include at least one of a photo sensor and a laser sensor.

The camera 121 and the laser sensor may be combined to detect a touch of the sensing object with respect to a 3D stereoscopic image. The photo sensor may be laminated on the display device. The photo sensor may be configured to scan a movement of the sensing object in proximity to the touch screen. In more detail, the photo sensor may include photo diodes and transistors at rows and columns to scan content placed on the photo sensor by using an electrical signal which changes according to the quantity of applied light. Namely, the photo sensor may calculate the coordinates of the sensing object according to variation of light to thus obtain position information of the sensing object.

The display unit 151 may output information processed in the mobile terminal 100. For example, the display unit 151 may display execution screen information of an application program driven in the mobile terminal 100 or user interface (UI) and graphic user interface (GUI) information in response to the execution screen information.

The display unit 151 may also be implemented as a stereoscopic display unit for displaying stereoscopic images.

The stereoscopic display unit 152 may employ a stereoscopic display scheme such as stereoscopic scheme (a glass scheme), an auto-stereoscopic scheme (glassless scheme), a projection scheme (holographic scheme), or the like.

The audio output module 152 may output audio data received from the wireless communication unit 110 or stored in the memory 160 in a call signal reception mode, a call mode, a record mode, a voice recognition mode, a broadcast reception mode, and the like. Also, the audio output module 152 may also provide audible output signals related to a particular function (e.g., a call signal reception sound, a message reception sound, etc.) performed by the mobile terminal 100. The audio output module 152 may include a receiver, a speaker, a buzzer or the like.

A haptic module 153 may generate various tactile effects the that user may feel. A typical example of the tactile effect generated by the haptic module 153 may be vibration. Strength, pattern and the like of the vibration generated by the haptic module 153 may be controllable by a user selection or setting of the controller. For example, the haptic module 153 may output different vibrations in a combining manner or a sequential manner.

Besides vibration, the haptic module 153 may generate various other tactile effects, including an effect by stimulation such as a pin arrangement vertically moving with respect to a contact skin, a spray force or suction force of air through a jet orifice or a suction opening, a touch on the skin, a contact of an electrode, electrostatic force, etc., an effect by reproducing the sense of cold and warmth using an element that can absorb or generate heat, and the like.

The haptic module 153 may be implemented to allow the user to feel a tactile effect through a muscle sensation such as the user's fingers or arm, as well as transferring the tactile effect through a direct contact. Two or more haptic modules 153 may be provided according to the configuration of the mobile terminal 100.

An optical output module 154 may output a signal for indicating an event generation using light of a light source. Examples of events generated in the mobile terminal 100 may include a message reception, a call signal reception, a missed call, an alarm, a schedule notice, an email reception, an information reception through an application, and the like.

A signal output by the optical output module 154 may be implemented in such a manner that the mobile terminal emits monochromatic light or light with a plurality of colors. The signal output may be terminated as the mobile terminal senses a user's event checking.

The interface unit 160 may serve as an interface with every external device connected with the mobile terminal 100. For example, the interface unit 160 may receive data transmitted from an external device, receive power to transfer to each element within the mobile terminal 100, or transmit internal data of the mobile terminal 100 to an external device. For example, the interface unit 160 may include wired or wireless headset ports, external power supply ports, wired or wireless data ports, memory card ports, ports for connecting a device having an identification module, audio input/output (I/O) ports, video I/O ports, earphone ports, or the like.

The identification module may be a chip that stores various information for authenticating authority of using the mobile terminal 100 and may include a user identity module (UIM), a subscriber identity module (SIM), a universal subscriber identity module (USIM), and the like. In addition, the device having the identification module (referred to as 'identifying device', hereinafter) may take the form of a smart card. Accordingly, the identifying device may be connected with the terminal 100 via the interface unit 160.

When the mobile terminal 100 is connected with an external cradle, the interface unit 160 may serve as a passage to allow power from the cradle to be supplied to the mobile terminal 100 therethrough or may serve as a passage to allow various command signals input by the user from the cradle to be transferred to the mobile terminal therethrough. Various command signals or power input from the cradle may operate as signals for recognizing that the mobile terminal is properly mounted on the cradle.

The memory 170 may store programs for operations of the controller 180 and temporarily store input/output data (for example, phonebook, messages, still images, videos, etc.). The memory 170 may store data related to various patterns of vibrations and audio which are output in response to touch inputs on the touch screen.

The memory 170 may include at least one type of storage medium including a Flash memory, a hard disk, a multimedia card micro type, a card-type memory (e.g., SD or DX memory, etc), a Random Access Memory (RAM), a Static Random Access Memory (SRAM), a Read-Only Memory (ROM), an Electrically Erasable Programmable Read-Only Memory (EEPROM), a Programmable Read-Only memory (PROM), a magnetic memory, a magnetic disk, and an optical disk. Also, the mobile terminal 100 may be operated in relation to a web storage device that performs the storage function of the memory 170 over the Internet.

As aforementioned, the controller 180 may typically control the general operations of the mobile terminal 100. For example, the controller 180 may set or release a lock state for restricting a user from inputting a control command with respect to applications when a status of the mobile terminal meets a preset condition.

The controller 180 may also perform controlling and processing associated with voice calls, data communications, video calls, and the like, or perform pattern recognition processing to recognize a handwriting input or a picture drawing input performed on the touch screen as characters or images, respectively. In addition, the controller 180 may control one or combination of those components in order to implement various exemplary embodiment disclosed herein on the mobile terminal 100.

The power supply unit 190 may receive external power or internal power and supply appropriate power required for operating respective elements and components included in the mobile terminal 100 under the control of the controller 180. The power supply unit 190 may include a battery. The battery may be an embedded battery which is rechargeable or be detachably coupled to the terminal body for charging.

The power supply unit 190 may include a connection port. The connection port may be configured as one example of the interface unit 160 to which an external (re)charger for supplying power to recharge the battery is electrically connected.

As another example, the power supply unit 190 may be configured to recharge the battery in a wireless manner without use of the connection port. Here, the power supply unit 190 may receive power, transferred from an external wireless power transmitter, using at least one of an inductive coupling method which is based on magnetic induction or a magnetic resonance coupling method which is based on electromagnetic resonance.

Various embodiments described herein may be implemented in a computer-readable or its similar medium using, for example, software, hardware, or any combination thereof.

Figure 1B:
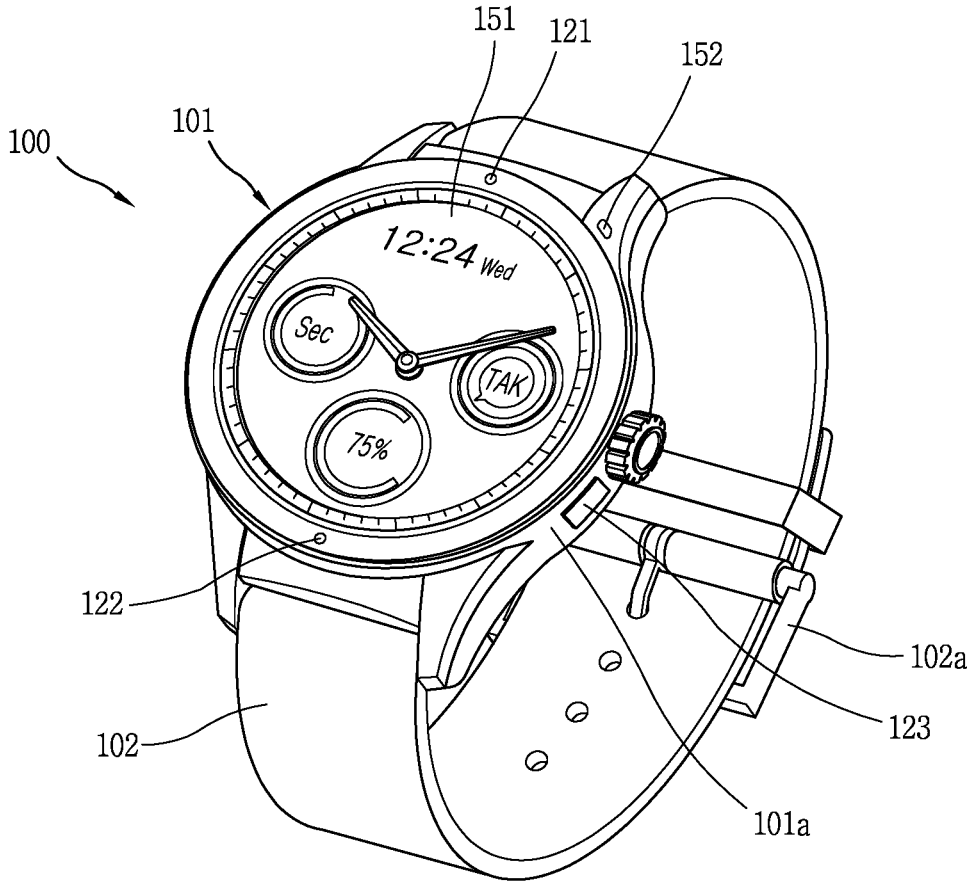
FIG. 1B is a view in which a watch type terminal according to an embodiment is seen from one direction.

FIG. 1B is a view illustrating a watch type terminal according to an embodiment when viewed from one direction.

As illustrated in FIG. 1B, the watch type terminal 100 may include a main body 101 with a display unit 151, and a band 102 connected to the main body 101 to be wearable on a wrist.

The main body 101 may include a case defining an appearance. As illustrated, the case may include a first case 101*a* and a second case 101*b* cooperatively defining an inner space for accommodating various electronic components. However, the present disclosure may not be limited to this. One case may be configured to define the inner space, thereby implementing a terminal 100 with a uni-body.

The watch type terminal 100 may be allowed to perform wireless communication, and an antenna for the wireless communication may be installed in the main body 101. The antenna may extend its function using a case. For example, a case including a conductive material may be electrically connected to the antenna so as to extend a ground area or a radiation area.

The display unit 151 may be disposed on a front surface of the main body 101 to output information thereon. The display unit 151 may be provided with a touch sensor so as to implement a touch screen. As illustrated, a window 151*a* of the display unit 151 may be mounted onto the first case 101*a* to form a front surface of the terminal body together with the first case 101*a*.

An audio output module 152, a camera 121, a microphone 122, a user input unit 123 and the like may be disposed on the main body 101. When the display unit 151 is implemented as the touch screen, it may function as the user input unit 123, which may result in excluding a separate key on the main body 101.

The band 102 may be worn on the wrist in a surrounding manner. The band 102 may be made of a flexible material for facilitating the wearing. As one example, the band 102 may be made of fur, rubber, silicon, synthetic resin or the like. The band 102 may also be configured to be detachable from the main body 101. Accordingly, the band 102 may be replaceable with various types of bands according to a user's preference.

On the other hand, the band 102 may be used for extending the performance of the antenna. For example, the band may include therein a ground extending portion (not shown) electrically connected to the antenna to extend a ground area.

The band 102 may be provided with a fastener 102*a*. The fastener 102*a* may be implemented into a buckle type, a snap-fit hook structure, a Velcro type, or the like, and include a flexible section or material. The drawing illustrates an example that the fastener 102*a* is implemented into the buckle type.

Figure 2A:
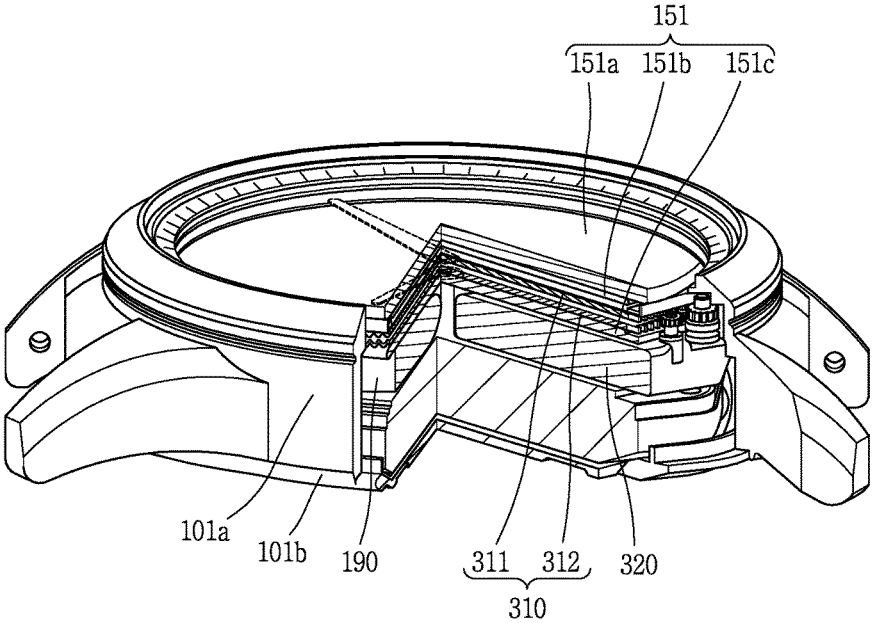
FIG. 2A is a cross-sectional view illustrating part of a watch type terminal according to an embodiment of the present disclosure.
Figure 2B:
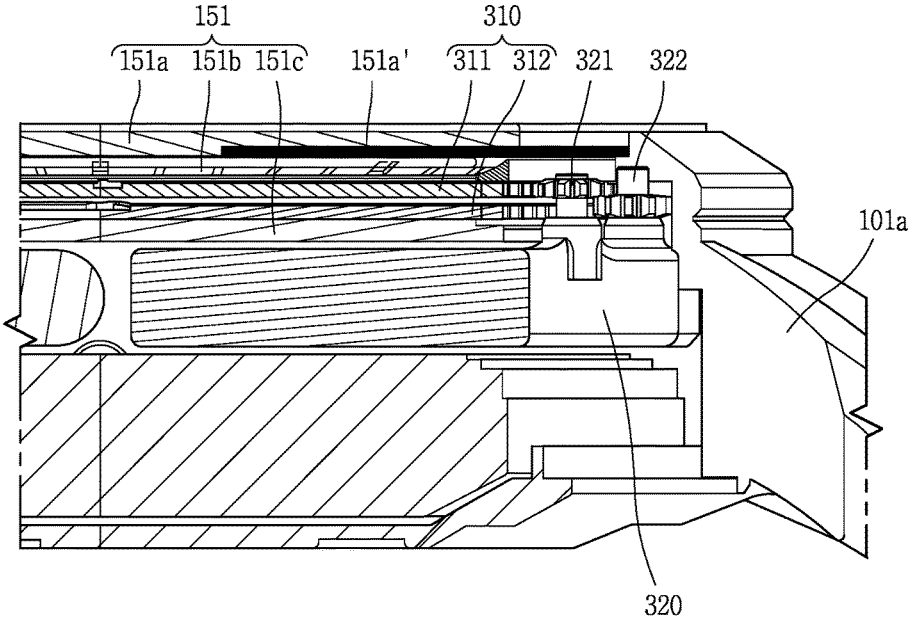
FIG. 2B is a partial cross-sectional view illustrating a watch type terminal in FIG. 2A.
Figure 2C:
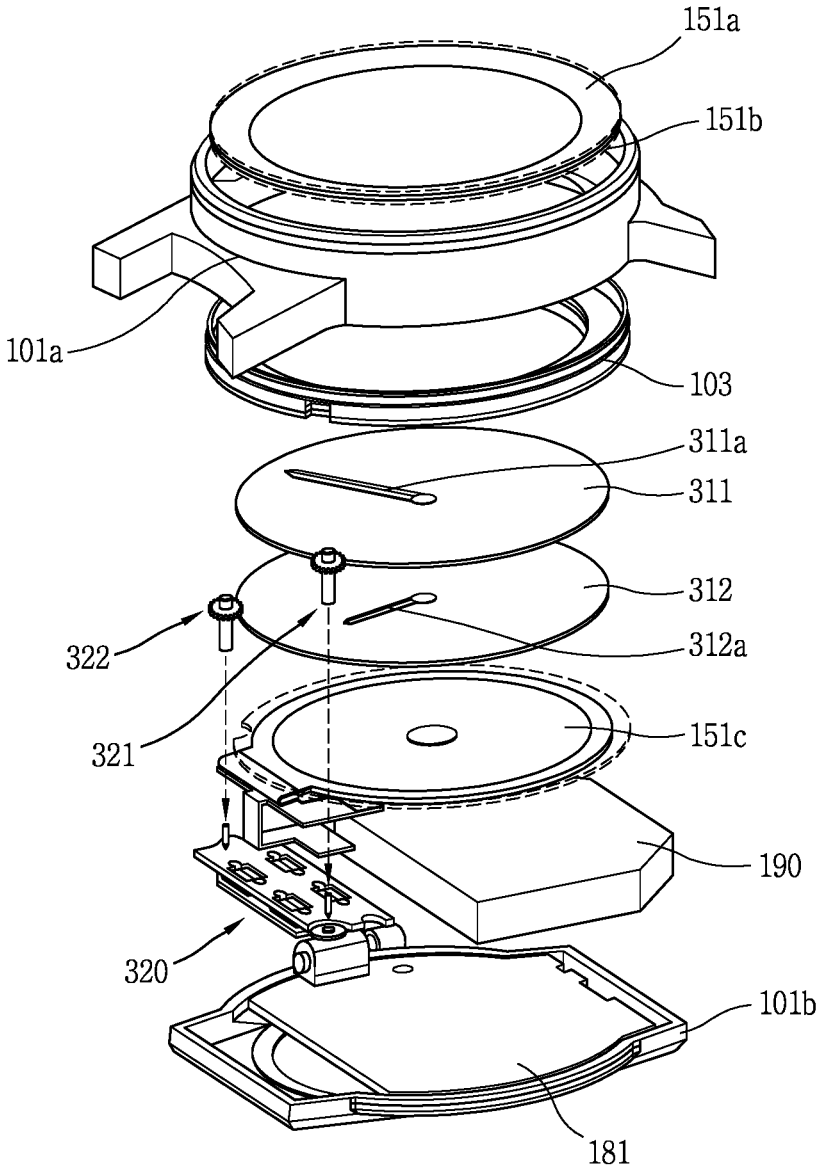
FIG. 2C is an exploded view illustrating a watch type terminal in FIG. 2A.
Figure 2D:
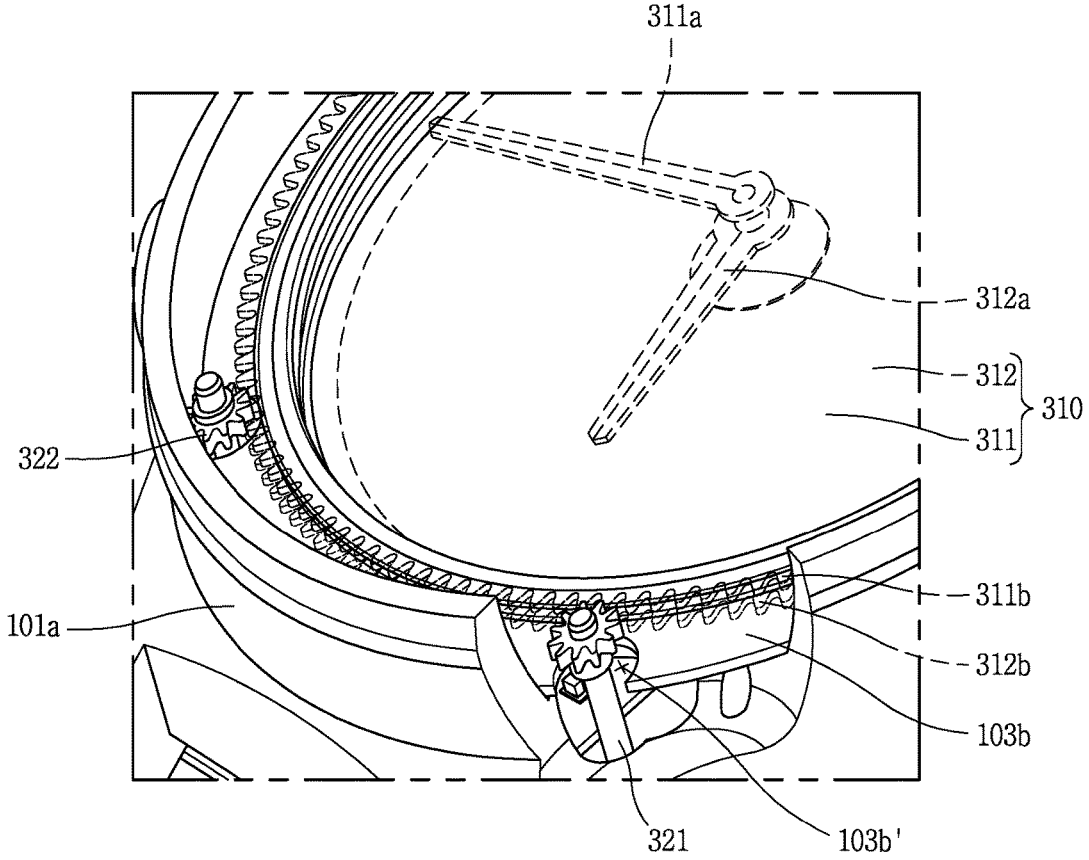
FIG. 2D is a conceptual view for explaining a gear unit of a disk.
Figure 2E:
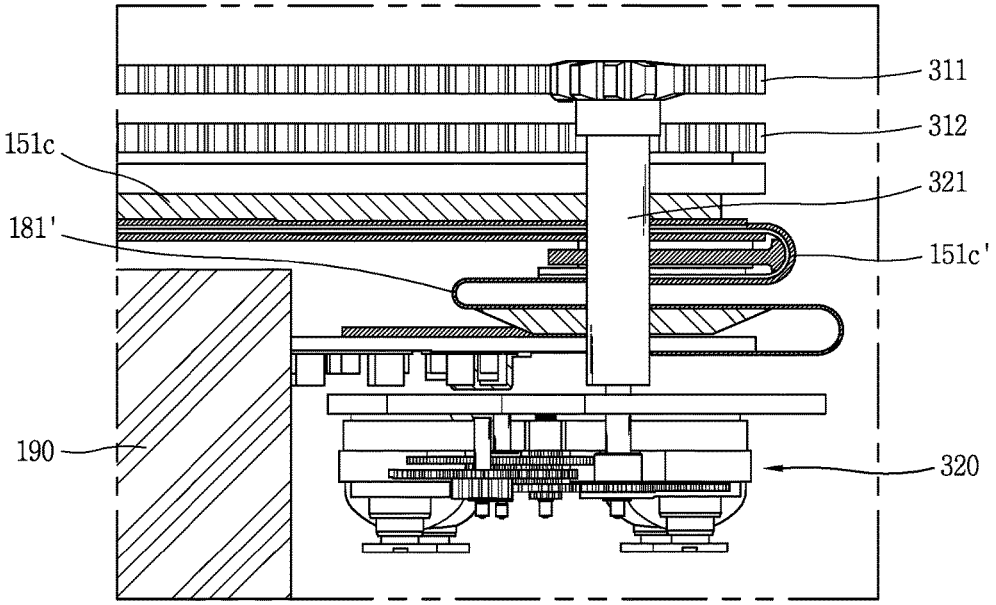
FIG. 2E is a conceptual view for explaining an arrangement structure with a gear pinion and a display module.

FIG. 2A is a cross-sectional view illustrating part of a watch type terminal according to an embodiment of the present disclosure, and FIG. 2B is a partial cross-sectional view illustrating a watch type terminal in FIG. 2A. FIG. 2C is an exploded view illustrating a watch type terminal in FIG. 2A, and FIG. 2D is a conceptual view for explaining a gear unit of a disk. FIG. 2E is a conceptual view for explaining an arrangement structure with a gear pinion and a display module.

Referring to FIGS. 2A through 2C, a watch type terminal 100 according to an embodiment of the present disclosure may include a window 151*a* and a touch sensor unit 151*b* mounted on the first case 101*a*, and a first disk 311, a second disk 312, a display module 151*c*, a rotation drive unit 320, a power supply unit 190 and a circuit board 181 disposed in an internal space formed by the first and the second case 101*a*, 101*b* and frame 103. The frame 103 is disposed in an internal space of the second case 101*b* and formed to support the first and the second disk 311, 312 and the display module 151*c*.

The first and the second disk 311, 312 is disposed in a space between the touch sensor unit 151*b* and the display module 151*c*. The first and the second disk 311, 312 is formed in a plate shape with a transparent material. A coating layer (not shown) may be formed on a surface to minimize a contact friction of the first and the second disk 311, 312.

Referring to FIG. 2E, the rotation drive unit 320 is disposed below the display module 151*c*. The display module 151*c* may include a display region for displaying visual information and a driving region 151*c*' formed at an edge of the display region for the processing of electrical signals. A flexible circuit board 181' extended from the driving region 151*c*' to be electrically connected to the circuit board 181 is accommodated below the display module 151*c*. The rotation drive unit 320 is disposed in a region overlapping with the driving region 151*c*' and flexible circuit board 181'.

Referring to FIG. 2B, the window 151*a* may include a print portion 151*a*' formed in one region on a region overlapping with the driving region 151*c*' and the rotation drive unit 320. The print portion 151*a*' is formed in one region of the window 151*a* to cover the remaining region (edge region) excluding the display region in which an image is displayed on the display module 151*c*. The driving region 151*c*' is not exposed to an outside by the print portion 151*a'*.

The rotation drive unit 320 and the power supply unit 190 may be disposed in parallel.

The first and the second disk 311, 312 is preferably formed in a circular shape to facilitate rotation by a gear. The centers of the first and the second disk 311, 312 are disposed to overlap with each other.

A first hand 311*a* is formed on the first disk 311, and a second hand 312*a* is formed on the second disk 312. One end portion of the first hand 311*a* is located at the center of the first disk 311, and one end portion of the second hand 312*a* is located at the center of the second disk 312, and the one end portions of the first and the second hand 311*a*, 312*a* are disposed to overlap with each other. Accordingly, it may be possible to implement actual clock hands in a shape that the first and the second hand 311*a*, 312*a* rotate around one axis.

The first and the second hand 311*a*, 312*a* may be printed on the first and the second disk 311, 312 or attached to the first and the second disk 311, 312 with a metal member. The first and the second hand 311*a*, 312*a* may be formed in different shapes. For example, the first hand 311*a* may be implemented as a minute hand, and the second hand 312*a* may be implemented as a hour hand. In this case, the first and the second hand 311*a*, 312*a* may be formed in different lengths.

The first and the second disk 311, 312 are formed of a transparent material, and thus both the first and the second hand 311*a*, 312*a* are seen through the window 151*a*. Furthermore, an image displayed by the display module 151*c* through the first and the second disk 311, 312 is displayed. The first and the second disk 311, 312 are formed in substantially the same size, and disposed to maintain a preset distance by the frame 103.

The rotation drive unit 320 for rotating the first and the second disk 311, 312 is disposed below the display module 151*c*. Specifically, the rotation drive unit 320 is located below the driving region 151*c*' of the display module 151*c*, and disposed adjacent to an edge of the body 101. As the rotation drive unit 320 is disposed below the display module 151*c*, the expansion of an internal space toward a outer region of the display module 151*c* is not required. Furthermore, the rotation drive unit 320 is disposed in parallel to the power supply unit 190, thereby minimizing a thickness of the watch type terminal 100.

Referring to FIGS. 2B and 2D, the gear portions of the first and the second gear pinion 321, 322 connected to the rotation drive unit 320 and extended along a direction in which the first and the second disk 311, 312 are deposited (a thickness direction of the body) are coupled to the outer circumferential regions of the first and the second disk 311, 312. The first and the second gear pinion 321, 322 are also disposed adjacent to an edge of the body 101.

Referring to FIG. 2D, the first and the second disk 311, 312 may include a first and a second gear portion 311*b*, 312*b* formed on the outer circumferential surfaces thereof, respectively. The first and the second gear portion 311*b*, 312*b* are formed to be engaged with the gear portions of the first and the second gear pinion 321, 322, respectively. The rotation drive unit 320 independently rotates the first and the second gear pinion 321, 322 according to the passage of time. The first and the second gear pinion 321, 322 may be connected to the rotation drive unit 320 formed in one module.

When the gear portions are formed at the end portions of the first and the second gear pinion 321, 322, the first and the second gear pinion 321, 322 may be formed to have different lengths. The first gear pinion 321 may be formed with a longer length than that of the second gear pinion 322 to be coupled to the first gear portion 311*b* of the first disk 311 disposed at a relatively upper portion thereof.

Alternatively, the gear portions formed on the first and the second gear pinion 321, 322 formed with the same length may be formed at different locations.

In order to differently set rotating rotation speeds, the gears of the first and the second gear portion 311*b*, 312*b* may be formed in different sizes. In this case, the sizes of the gear portions of the first and the second gear pinion 321, 322 coupled to the first and the second gear portion 311*b*, 312*b*, respectively, may be formed in a different manner. In other words, even when the first and the second gear pinion 321, 322 rotate at the same speed by the rotation drive unit 320, the first and the second disk 311, 312 may rotate in different speeds.

Alternatively, the rotation drive unit 320 may include different sizes of gears connected to the first and the second gear pinion 321, 322.

When the first and the second gear portion 311*b*, 312*b* of the first and the second disk 311, 312 are formed in the same shape, the rotation drive unit 320 should rotate the first and the second gear pinion 321, 322 at different speeds to indicate a time. The rotation drive unit 320 may include a motor and a plurality of gears rotating in engagement with each other to rotate the first and the second disk 311, 312 to indicate a time.

The rotation drive unit 320 rotates the first and the second gear pinion 321, 322 to indicate a time by the position of the first and the second hand 311*a*, 312*a* formed on the first and the second disk 311, 312.

Referring to FIGS. 2C and 2D, the frame 103 supports the first and the second disk 311, 312 through the first and the second gear pinion 321, 322. The first and the second disk 311, 312 are separated from each other by the frame 103 and disposed not to collide with each other.

FIGS. 3A through 3D are views for explaining a structure of a frame supporting a first and a second disk.

Figure 3A:
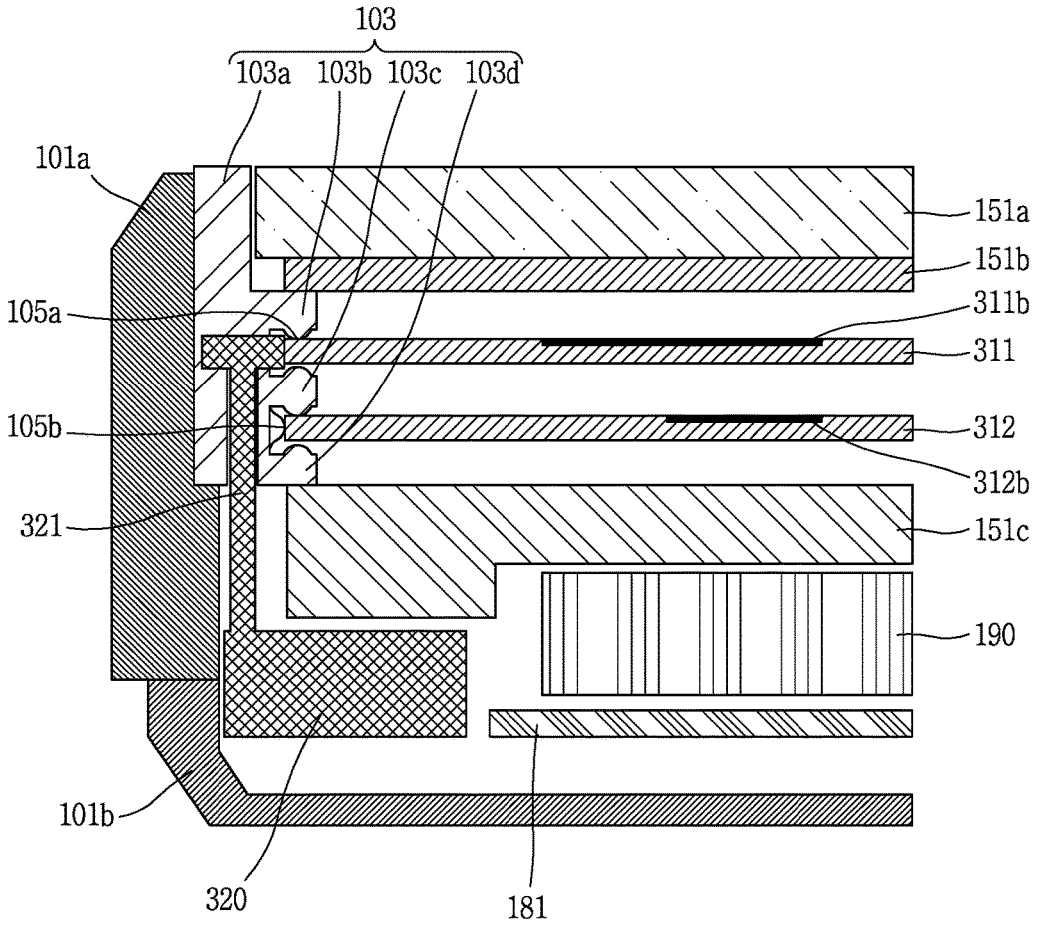
FIGS. 3A through 3D are views for explaining a structure of a frame supporting a first and a second disk.
Figure 3B:
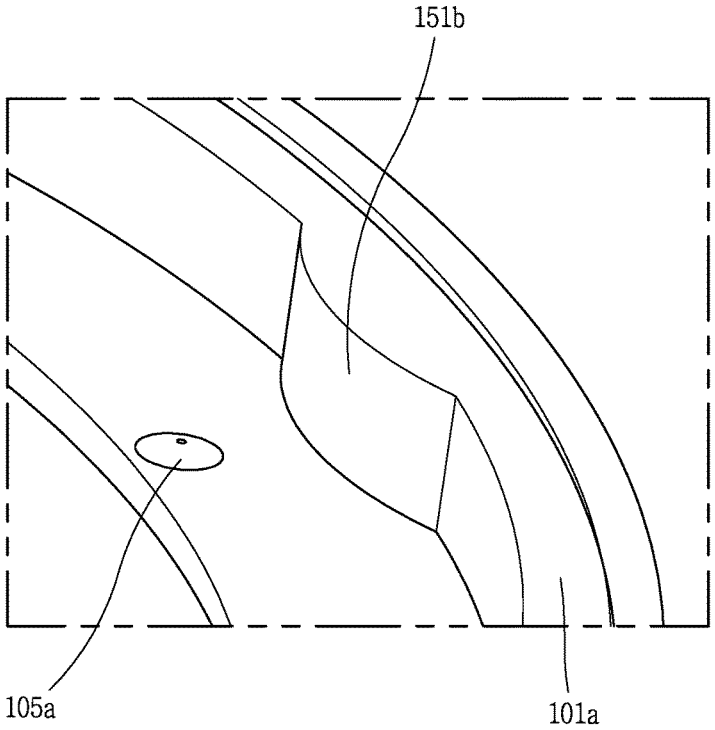
Figure 3C:
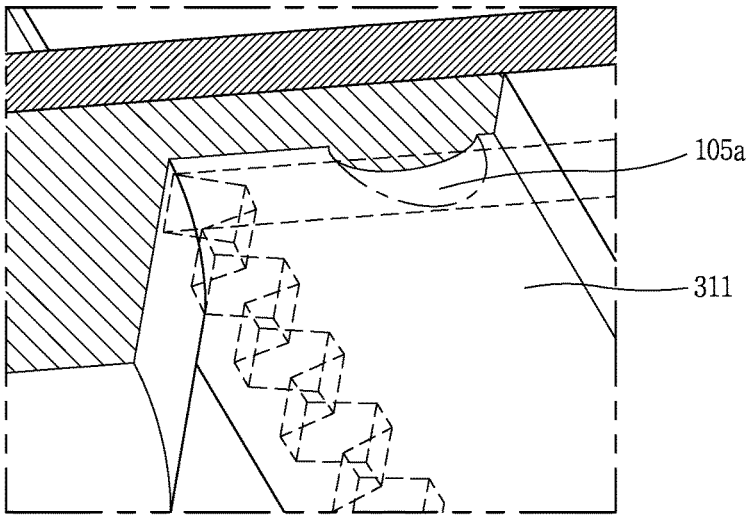

FIG. 3A is a conceptual view for explaining a frame structure according to an embodiment of the present disclosure, and FIG. 3B is a view in which a main support portion and a first support portion of the frame are seen from one direction. FIG. 3C is a partial cross-sectional view illustrating a shape in which the first disk is supported on the first protrusion.

The frame is disposed within the first and the second case 101*a*, 101*b*, and formed to support an edge of the first and the second disk 311, 312. Specifically, the frame may include a main support portion 103*a*, and a first through a third support portion 103*b*, 103*c*, 103*d* protruded from the main support portion 103*a* with a preset width. the main support portion 103*a* is formed along an inner surface of the first case 101*a*. The first through the third support portion 103*b*, 103*c*, 103*d* are formed along an inner circumferential surface of the main support portion 103*a*.

The first support portion 103*b* supports the window 151*a* and the touch sensor unit 151*b*, and the first disk 311 is disposed below the first support portion 103*b*. The first disk 311 is disposed between the first and the second support portion 103*b*, 103*c*. A plurality of first protrusions 105*a* are formed at least one surface of the first and the second support portion 103*b*, 103*c* facing the first disk 311.

The first protrusions 105*a* formed on the first and the second support portion 103*b*, 103*c* may be formed in overlapping regions with each other, but may not be necessarily limited to this. The second support portion 103*c* supports the first disk 311 including at least three first protrusions 105*a* to make a horizontal position.

The plurality of first protrusions 105*a* are formed in substantially the same size, and a surface of the first protrusion 105*a* is formed on a convex curved surface. The first disk 311 is brought into point contact with the first protrusion 105*a* to minimize a friction with the frame while the first disk 311 rotates. A space between a surface of the first through the third support portion 103*b*, 103*c*, 103*d* and the first and the second disk 311, 312 is formed by the first protrusion 105*a*.

The first protrusion 105*a* is formed only on one surface of the first support portion 103*b*, and the first protrusion 105*a* is formed on both surfaces of the second support portion 103*c* to support the first and the second disk 311, 312.

The third support portion 103*d* may include the first protrusion 105*a* formed on one surface thereof, and the second disk 312 is supported by the first protrusion 105*a* formed on the third support portion 103*d*. Accordingly, the first and the second disk 311, 312 may be stably supported not to be brought into contact with each other so as to minimize a contact friction while the first and the second disk 311, 312 rotate.

A gap between the first through the third support portion 103*b*, 103*c*, 103*d* is determined by a thickness of the first and the second disk 311, 312 and a thickness of the first and the second hand 311*a*, 312*a* formed on the first and the second disk 311, 312.

Figure 3D:
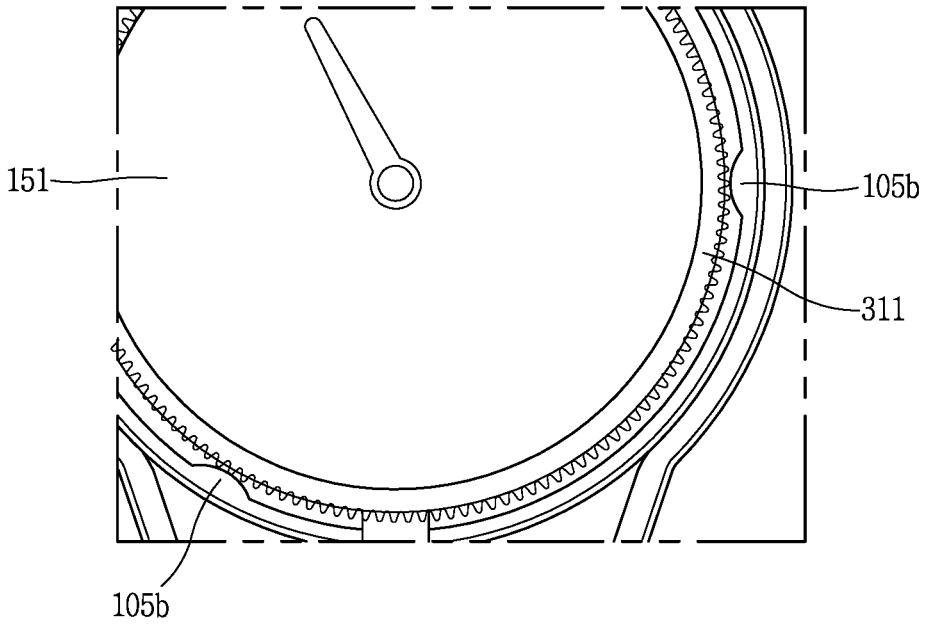

FIG. 3D is a conceptual view for explaining a second protrusion 105*b* protruded from an inner circumferential surface of the main support portion 103*a*.

Referring to FIGS. 3B and 3D, the main support portion 103*a* may include the second protrusion 105*b* formed between the first through the third support portion 103*b*, 103*c*, 103*d*. The second protrusion 105*b* is protruded from an inner circumferential surface of the main support portion 103*a*, and the main support portion 103*a* may include at least three second protrusions 105*b* disposed to be separated from each other.

The second protrusion 105*b* is formed to form a convex curved surface to be brought into point contact with an outer circumferential surface of the first and the second disk 311, 312. The second protrusion 105*b* is brought into contact with the edge region of the first and the second gear portion 311*b*, 312*b*. Accordingly, it may be possible to minimize the wobble of the first and the second disk 311, 312 as well as minimizing a contact friction while the first and the second disk 311, 312 rotate.

Referring to FIG. 2D again, a through hole 103*b*' through which the first and the second gear pinion 321, 322 pass is formed on the frame 103. The through hole 103*b*' may include a first region formed in the stacking direction of the main support portion 103*a* and a second region formed to expose one region of the gear pinion to an inner circumferential surface of the main support portion 103*a*.

The disks may be supported by a frame supporting the disks and a plurality of protrusions formed on the frame to rotate in a minimized contact friction state while not being collided with each other. Accordingly, it may be possible to prevent the vibration and movement of the disks even while transferring a rotational force through part of an outer circumferential surface of the disks.

Figure 4A:
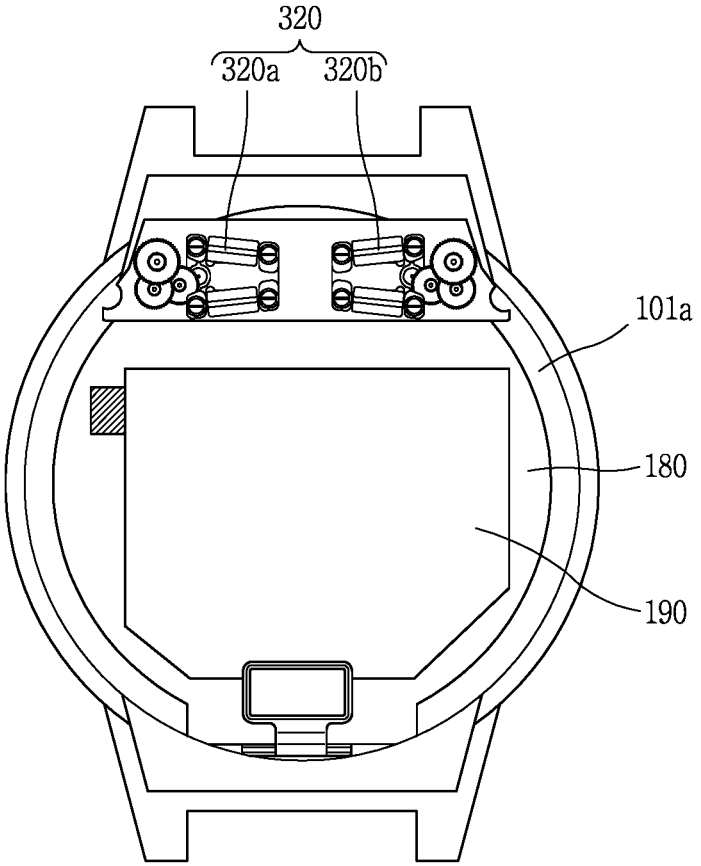
FIG. 4A is a conceptual view for explaining an individual drive unit according to an embodiment of the present disclosure.
Figure 4B:
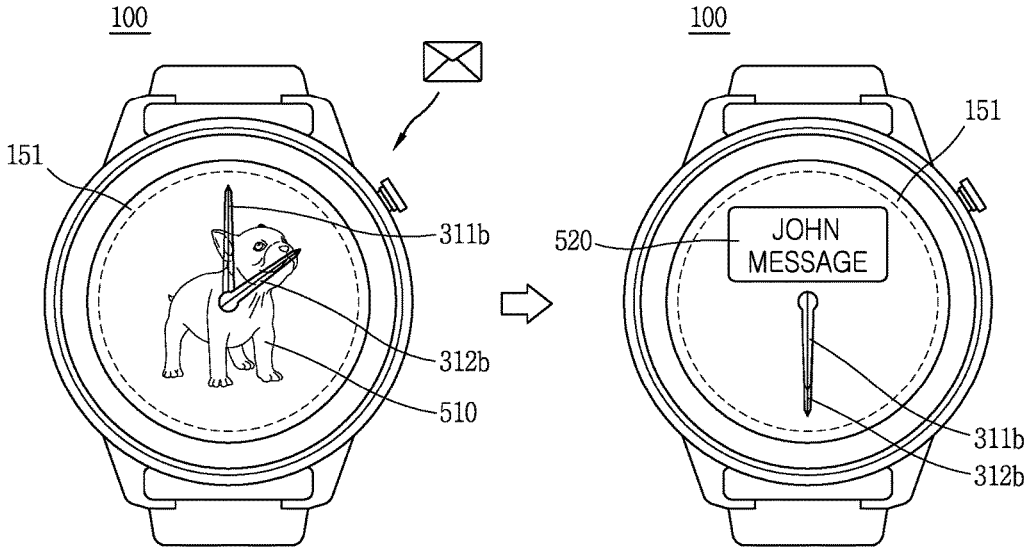
FIG. 4B is a conceptual view for explaining a control method of a hand according to a rotation drive unit.

FIG. 4A is a conceptual view for explaining an individual drive unit according to an embodiment of the present disclosure, and FIG. 4B is a conceptual view for explaining a control method of a hand according to a rotation drive unit.

The rotation drive unit 320 according to the present embodiment may include a first drive portion 320*a* for rotating the first disk 311 and a second drive portion 320*b* for rotating the second disk 312. The first and the second drive portion 320*a*, 320*b* may include an independent motor and at least one gear, respectively. The first and the second drive portion 320*a*, 320*b* independently rotate the first and the second disk 311, 312. The controls of the first and the second drive portion 320*a*, 320*b* are independent from each other, and thus the first and the second disk 311, 312 are not interlocked with each other according to the passage of time.

The rotation drive unit 320 may be electrically connected to the circuit board 181 and controlled by the controller 180 to rotate the first and the second disk 311, 312. In other words, the rotation drive unit 320 according to an embodiment of the present disclosure does not require an individual control unit for autonomously rotating the hands.

Though not shown in detail in the drawing, the rotation drive unit 320 may be directly disposed on the circuit board 181 or the rotation drive unit 320 and the circuit board 181 may be electrically connected by a flexible circuit board.

The controller controls the rotation of the rotation drive unit 320 using time information received by GPS or the like. Accordingly, an individual control unit of the rotation drive unit 320 is not required and thus an internal space is secured, and it is not required to compensate an error of time by rotating the hands. Furthermore, the first and the second drive portion 320*a*, 320*b* may independently rotate the first and the second disk 311, 312, and thus move the first and the second hand 311*a*, 312*a* regardless of a current time.

FIG. 4B is a conceptual view for explaining a control method of independently moving the first and the second hand according to an embodiment. Referring to FIG. 4B, the controller 180 controls the rotation drive unit 320 to rotate the first and the second disk 311, 312 based on time information. The display unit 151 displays screen information 510 while the first and the second hand 311*a*, 312*a* indicate a time by the rotation of the first and the second disk 311, 312. The screen information 510 is provided to a user in a state that part of the screen information 510 is covered by the first and the second hand 311*a*, 312*a*.

The controller may rotate the first and the second disk 311, 312 to move the position of the first and the second hand 311*a*, 312*a* regardless of the time information in a specific condition.

When the screen information 510 is changed, for example, when an image 520 regarding a received event is displayed on the display unit 151, the controller 180 may control the first and the second drive portion 320*a*, 320*b*, respectively, to move the first and the second hand 311*a*, 312*a*.

The controller 180 controls the first and the second disk 311, 312, respectively, to move the first and the second hand 311*a*, 312*a* to substantially the same position. The rotation ranges of the first and the second disk 311, 312 may be controlled in a different manner.

Referring to FIG. 4B, the first and the second hand 311*a*, 312*a* may be disposed at the same position while the image is displayed, thereby securing a space capable of displaying an image.

The controller may control the first and the second drive portion 320*a*, 320*b* again to indicate a current time based on time information received by the GPS or the like when the image 520 disappears.

Figure 5A:
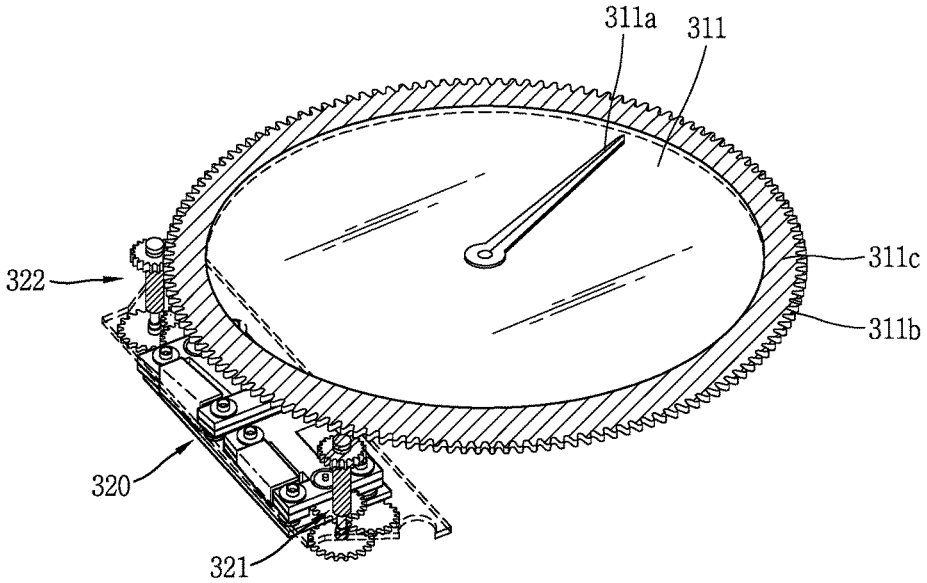
FIGS. 5A and 5B are conceptual views for explaining a gear pinion and a disk for implementing an antenna function.
Figure 5B:
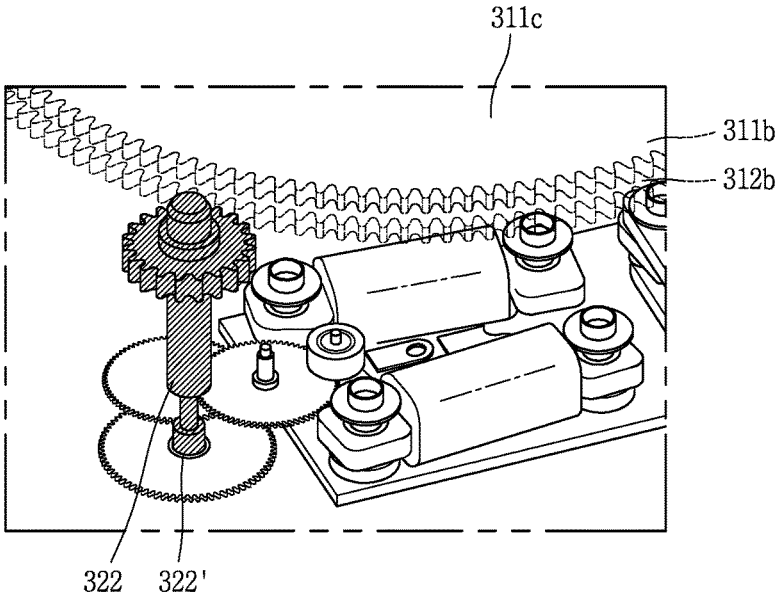

FIGS. 5A and 5B are conceptual views for explaining a gear pinion and a disk for implementing an antenna function.

According to an embodiment of the present disclosure, part of the first and the second disk 311, 312 and at least one of the first and the second gear pinion 321, 322 may be formed of a metal material to perform a function of an antenna.

For example, the first gear pinion 321 and a metal portion 311*c* with a metal material formed in an edge region of the first disk 311 coupled to the first gear pinion 321 may be implemented as one antenna. Furthermore, the second gear pinion 322 separately from the first gear pinion 321 may be also used as one antenna. Accordingly, two antennas with different lengths may be formed, and thus carried out as two antennas with different characteristics (for example, BLUETOOTH™ (BT), WiFi antenna, etc.).

Referring to FIG. 5A, the first disk 311 may be defined as an edge region of the first disk 311 including the first gear portion 311*b*, and may include a metal portion 311*c* formed of a metal material. The remaining region excluding the metal portion 311*c* may be formed of a transparent glass material. A width of the metal portion 311*c* may be preferably formed to be smaller than that of the print portion.

A first antenna is implemented by the metal portion 311*c* and the first gear pinion 321. The first gear pinion 321 may be electrically connected to the circuit board 181, and coupled to an insulating portion 322' for blocking an electrical connection to another constituent element (for example, a gear included in the rotation drive unit 320).

On the other hand, it may be implemented as a second antenna having a different characteristic from that of the second gear antenna. The second gear pinion 322 is electrically connected to the circuit board 181. However, the second gear portion 312*b* of the second disk 312 coupled to the second gear pinion 322 is formed of an insulating material. For example, the second disk 312 is formed of a glass material.

According to the present embodiment, it may be possible to implement a first and a second antenna formed with different lengths to have different frequencies. Accordingly, an additional antenna portion may not be required to facilitate the securing of a space.

Figure 6:
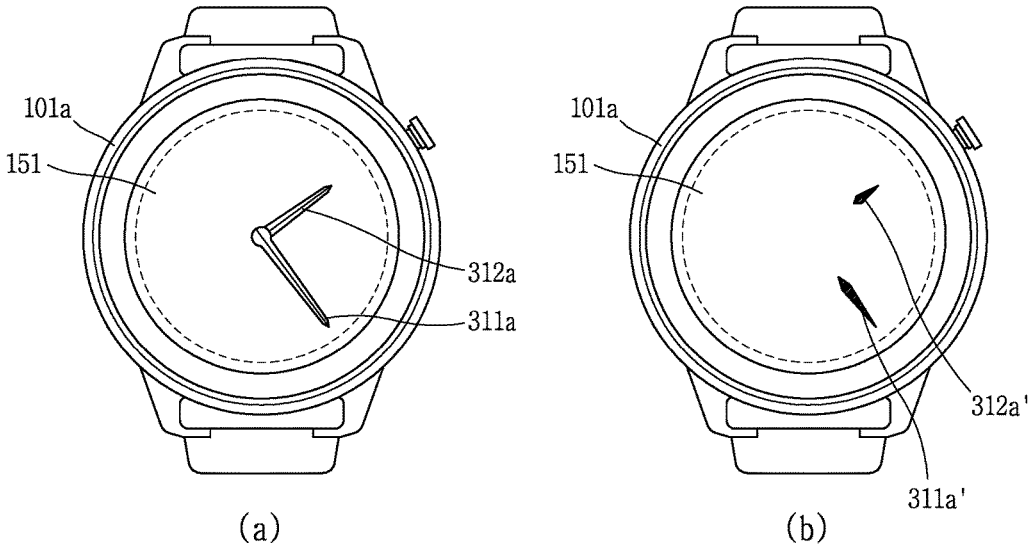
FIG. 6 is a conceptual view for explaining the shape of a hand according to another embodiment.

FIG. 6 is a conceptual view for explaining the shape of a hand according to another embodiment.

Referring to FIG. 6A, the first and the second hand 311*a*, 312*a* are formed in such a manner that one end portions thereof continue to overlap with each other. The one end portions thereof may be preferably located at the center of the display unit 151.

Referring to FIG. 6B, the first and the second hand 311*a*', 312*a*' are disposed adjacent to the edges of the first and the second disk 311, 312, and formed to overlap with each other only at a specific time. The first and the second hand 311*a*', 312*a*' are not formed at the central portions of the first and the second disk 311, 312 not to cover an image displayed at the central portion of the display unit 151.

The display unit 151 may display a hand image connected to the first and the second hand 311*a*', 312*a*' according to a specific condition. However, the image of the first and the second hand may not be necessarily limited to the drawing.

Furthermore, the number of disks formed with hands may not be necessarily limited to two, and the present disclosure may include a plurality of disks to indicate additional time information.

The foregoing present disclosure may be implemented as codes readable by a computer on a medium written by the program. The computer-readable media includes all types of recording devices in which data readable by a computer system can be stored. Examples of the computer-readable media may include HDD (Hard Disk Drive), SSD (Solid State Disk), SDD (Silicon Disk Drive), ROM, RAM, CD-ROM, a magnetic tape, a floppy disk, an optical data storage device, and the like, and also include a device implemented via a carrier wave (for example, transmission via the Internet). Furthermore, the computer may include the controller 180 of the terminal. The detailed description is, therefore, not to be construed as restrictive in all respects but considered as illustrative. The scope of the invention should be determined by reasonable interpretation of the appended claims and all changes that come within the equivalent scope of the invention are included in the scope of the invention.

What is claimed is:

1. A watch type terminal comprising:

a body including:

a first disk having a first hand;

a second disk having a second hand, the second disk located below the first disk;

a display module located below the second disk;

a first pinion coupled to the first disk;

a second pinion coupled to the second disk;

a driver configured to provide a rotational force to the first pinion and the second pinion to rotate the first and the second disks, respectively, so as to convey visual information by the first hand and the second hand; and a frame supporting the first disk and the second disk, and a band connected to the body, wherein the frame includes:

a main support portion surrounding the first and second disks and having through holes through which the first and the second gear pinions pass; and first, second and third support portions protruding from an inner surface of the main support portion, the first support portion being disposed between the first disk and the display module, and the second support portion being disposed between the first disk and the second disk to separate the first disk from the second disk.

2. The watch type terminal of claim 1, wherein the first pinion engages an edge of the first disk.

3. The watch type terminal of claim 2, wherein the second pinion engages an edge of the second disk.

4. The watch type terminal of claim 3, wherein each of the edges of the first disk and the second disk are configured to form a gear, and wherein each of the edges of the first disk and the second disk are coupled to the first pinion and the second pinion, respectively.

5. The watch type terminal of claim 4, wherein the driver comprises a first drive arrangement and a second drive arrangement configured to rotate the first pinion and the second pinion, respectively, so as to independently rotate the first disk and the second disk.

6. The watch type terminal of claim 1, wherein the driver comprises a first drive arrangement and a second drive arrangement configured to rotate the first pinion and the second pinion, respectively, so as to independently rotate the first disk and the second disk.

7. The watch type terminal of claim 1, wherein the first pinion and the second pinion are disposed adjacent to an edge of the display.

8. The watch type terminal of claim 1, wherein the first support portion, the second support portion and the third support portion are each separated by a predetermined width.

9. The watch type terminal of claim 8, wherein each of the first support portion, second support portion and third support portion includes at least one first protrusion having a curved surface to be in point contact with one of the first disk and the second disk.

10. The watch type terminal of claim 9, wherein the main support portion includes a plurality of second protrusions protruded from the main support portion to be in point contact with an outer circumferential surface of at least one of the first disk and the second disk.

11. The watch type terminal of claim 9, wherein the first disk is located between the first and second support portions and the second disk is located between the second and third support portions, and wherein each of the second and third support portions includes a pair of spaced through holes to allow the first pinion and the second pinion to pass therethrough.

12. The watch type terminal of claim 1, further comprising a circuit board disposed within the body to perform signal processing, wherein the driver is connected to the circuit board, the driver being configured to rotate the first disk and the second disk by a control signal received from the circuit board.

13. The watch type terminal of claim 1, further comprising a window and a touch screen, the window and touch screen being disposed above the first disk.

14. The watch type terminal of claim 13, wherein, except for the first hand and the second hand, the first disk and the second disk are transparent.

15. The watch type terminal of claim 14, wherein the display module includes a display region in which visual information is displayed and a driving region for processing of electrical signals, and the driver is disposed to overlap with the driving region.

16. The watch type terminal of claim 1, further comprising:

a first antenna, the first antenna being formed by the first pinion and a metal material located in an edge region of the first disk, the first pinion being made of metal; and a second antenna being formed with the second pinion, the second pinion being made of metal.

17. The watch type terminal of claim 1, wherein the first hand and the second hand are printed on or attached to the first disk and the second disk, respectively.

18. The watch type terminal of claim 1, wherein the band is adjustable.

* * * * *